US008622467B2

(12) United States Patent
Murphy et al.

(10) Patent No.: US 8,622,467 B2
(45) Date of Patent: Jan. 7, 2014

(54) RECLINING SEATING UNIT WITH TILTABLE HEADREST

(75) Inventors: Marcus L. Murphy, Lexington, NC (US); D. Stephen Hoffman, High Point, NC (US)

(73) Assignee: Ultra-Mek, Inc., Denton, NC (US)

( * ) Notice: Subject to any disclaimer, the term of this patent is extended or adjusted under 35 U.S.C. 154(b) by 72 days.

(21) Appl. No.: 13/372,812

(22) Filed: Feb. 14, 2012

(65) Prior Publication Data

US 2013/0140856 A1 Jun. 6, 2013

Related U.S. Application Data

(63) Continuation-in-part of application No. 13/312,056, filed on Dec. 6, 2011.

(51) Int. Cl.

| | |
|---|---|
| ***A47C 1/02*** | (2006.01) |
| ***A47C 1/034*** | (2006.01) |
| ***A47C 1/035*** | (2006.01) |
| ***A47C 1/036*** | (2006.01) |
| ***A47C 1/037*** | (2006.01) |

(52) U.S. Cl.
USPC ..... 297/85 R; 297/83; 297/84

(58) Field of Classification Search
USPC ..... 297/83, 84, 85 R, 85 M, 85 L, 85 C, 86, 297/87, 88, 89, 90, 91
See application file for complete search history.

(56) References Cited

U.S. PATENT DOCUMENTS

| | | | |
|---|---|---|---|
| 2,843,183 | A | 7/1958 | Luckhardt |
| 2,843,184 | A | 7/1958 | Lorenz |
| 2,869,619 | A | 1/1959 | Petersen et al. |
| 2,984,293 | A | 5/1961 | Bontempi et al. |
| 2,996,332 | A | 8/1961 | Kurtyka et al. |
| 3,021,098 | A | 2/1962 | Spound |
| 3,057,657 | A | 10/1962 | Fletcher |
| 3,074,758 | A | 1/1963 | Schliephacke |
| RE25,375 | E | 4/1963 | Lorenz |
| 3,102,753 | A | 9/1963 | Schliephacke |
| 3,140,117 | A | 7/1964 | Fletcher |

(Continued)

FOREIGN PATENT DOCUMENTS

| | | |
|---|---|---|
| DE | 26 01 691 A1 | 7/1977 |

OTHER PUBLICATIONS

The International Search Report and Written Opinion for PCT/US2008/010721, dated Sep. 15, 2008.

*Primary Examiner* — Rodney B White
(74) *Attorney, Agent, or Firm* — Myers Bigel Sibley & Sajovec, P.A.

(57) ABSTRACT

A reclining seating unit includes: a base; a seat; a backrest; a reclining mechanism attached to the base, seat and backrest, the reclining mechanism configured to move the seating unit between an upright position and a fully reclined position; a headrest that is positioned in front of an upper portion of the backrest; and a headrest mechanism attached to the headrest and to the reclining mechanism. The headrest mechanism is configured to move the headrest from a retracted position when the seating unit is in its upright position to an extended position when the seating unit is in its fully reclined position. In the retracted position the headrest is generally parallel with the backrest and in the extended position the headrest defines an angle with the backrest in which the front surface of headrest is rotated to partially face the front surface of the backrest.

10 Claims, 7 Drawing Sheets

(56) References Cited

U.S. PATENT DOCUMENTS

| | | | |
|---|---|---|---|
| 3,652,125 | A | 3/1972 | Rogers, Jr. |
| 3,836,197 | A | 9/1974 | Goff et al. |
| 3,844,607 | A | 10/1974 | Re |
| 3,871,704 | A | 3/1975 | Shoemaker et al. |
| 3,942,835 | A | 3/1976 | Harrison |
| 3,958,827 | A | 5/1976 | Re |
| 4,188,062 | A | 2/1980 | Rogers, Jr. et al. |
| 4,216,992 | A | 8/1980 | Crum |
| 4,691,961 | A | 9/1987 | Rogers, Jr. et al. |
| 4,718,716 | A | 1/1988 | Stumpf et al. |
| 4,805,960 | A | 2/1989 | Tacker |
| 4,830,429 | A | 5/1989 | Petitjean |
| 4,895,411 | A | 1/1990 | Pine |
| 5,044,692 | A | 9/1991 | Tidwell, Jr. et al. |
| 5,054,850 | A | 10/1991 | Pine |
| 5,129,701 | A | 7/1992 | Pine |
| 5,310,243 | A | 5/1994 | Pine |
| RE34,666 | E | 7/1994 | Tacker |
| 5,346,277 | A | 9/1994 | Holobaugh et al. |
| 5,374,100 | A | 12/1994 | Rogers et al. |
| 5,595,420 | A | 1/1997 | Rogers |
| 5,775,775 | A | 7/1998 | Hoffman |
| 5,800,010 | A | 9/1998 | May |
| 6,192,565 | B1 | 2/2001 | Tame |
| 6,769,734 | B2 | 8/2004 | Tacker |
| 7,669,921 | B2 | 3/2010 | Hoffman et al. |
| 2013/0140855 | A1* | 6/2013 | Murphy et al. ..... 297/61 |

* cited by examiner

RECLINING SEATING UNIT WITH TILTABLE HEADREST

RELATED APPLICATION

The present invention is a continuation-in-part of U.S. patent application Ser. No. 13/312,056, filed Dec. 6, 2011, the disclosure of which is hereby incorporated herein in its entirety.

FIELD OF THE INVENTION

The present invention relates generally to seating units, and more particularly to seating units with reclining capability.

BACKGROUND OF THE INVENTION

Conventionally, a recliner chair will move from an upright position, in which the backrest is generally upright, to one or more reclined positions, in which the backrest pivots to be less upright. The movement of the seating unit between the upright and reclined positions is typically controlled by a pair of synchronized reclining mechanisms that are attached to the seat, backrest and base of the chair. Many recliners will have an extendable footrest or ottoman that provides support for the occupant's feet in the reclined position.

One particularly popular recliner is the "three-way" recliner, which has two reclined positions: an intermediate "TV position", in which the footrest or ottoman of the chair is projected forwardly from the chair while the backrest remains substantially upright relative to the seat; and a "fully reclined position", in which the backrest is less upright (i.e., it has been reclined to a shallower angle relative to the floor). In a "three-way" recliner, the backrest pivots relative to the seat as the chair takes its fully reclined position; this differs from a "two-way" recliner, in which the backrest and seat are rigidly fixed and do not pivot relative to one another as the chair moves to the fully reclined position, and from a "one-way" recliner, which typically has no intermediate "TV" position.

One recliner chair feature that has become popular in some models is a headrest that is retracted when the recliner chair is in its upright position and extends when the reclining chair moves to a reclined position. Such a headrest can provide support for the occupant's head, which may increase comfort for a reclining occupant. An exemplary headrest is described and illustrated in U.S. Pat. No. 5,346,277 to Holobaugh et al. The chair illustrated therein includes a headrest that is generally horizontally disposed atop the backrest when the chair is in the upright position and generally vertically disposed above the backrest when the chair is in a reclined position. A headrest that folds within a cavity in the rear surface of the backrest, then inverts as it extends, is illustrated in U.S. Pat. No. 3,652,125 to Rogers. Another example is shown in U.S. Pat. No. 7,669,921 to Hoffman et al., which discloses a headrest that separates from the backrest when the footrest extends. The disclosures of each of these patents are hereby incorporated herein by reference.

As chair styling continues to evolve, it may be desirable to provide additional headrest configurations.

SUMMARY OF THE INVENTION

As a first aspect, embodiments of the present invention are directed to a reclining seating unit. The reclining seating unit comprises: a base configured to rest on an underlying surface; a seat; a backrest; a reclining mechanism attached to the base, seat and backrest, the reclining mechanism configured to move the seating unit between an upright position, in which the seat is disposed above the base and the backrest defines a first backrest angle relative to the seat, and a fully reclined position, in which the backrest has reclined relative to the seat to a second backrest angle that exceeds the first backrest angle; a headrest that is positioned in front of an upper portion of the backrest; and a headrest mechanism attached to the headrest and to the reclining mechanism. The headrest mechanism is configured to move the headrest from a retracted position when the seating unit is in its upright position to an extended position when the seating unit is in its fully reclined position. In the retracted position, the headrest is generally parallel with the backrest, and in the extended position, the headrest defines an angle with the backrest in which the front surface of headrest is rotated to partially face the front surface of the backrest.

As a second aspect, embodiments of the present invention are directed to a reclining seating unit, comprising: a base configured to rest on an underlying surface; a seat; a backrest; a reclining mechanism attached to the base, seat and backrest, the reclining mechanism configured to move the seating unit between an upright position, in which the seat is disposed above the base and the backrest defines a first backrest angle relative to the seat, and a fully reclined position, in which the backrest has reclined relative to the seat to a second backrest angle that exceeds the first backrest angle; a headrest that is positioned in front of an upper portion of the backrest; and a headrest mechanism attached to the headrest and to the reclining mechanism. The headrest mechanism is configured to move the headrest from a retracted position when the seating unit is in its upright position to an extended position when the seating unit is in its fully reclined position, wherein in the extended position the headrest is tilted forward with respect to the backrest compared to the retracted position.

DETAILED DESCRIPTION OF EMBODIMENTS OF THE INVENTION

Figure 1:
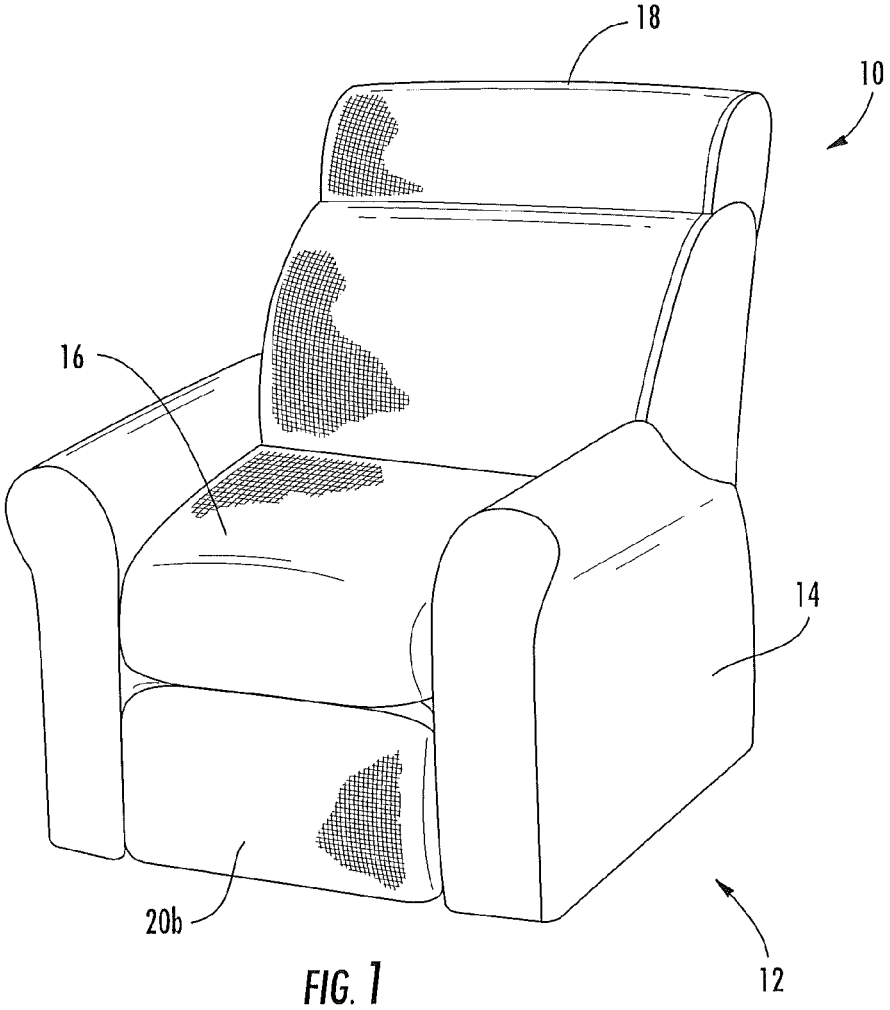
FIG. 1 is a perspective view of a reclining chair according to embodiments of the present invention, with the chair in its upright position.

The present invention will be described more particularly hereinafter with reference to the accompanying drawings.

The invention is not intended to be limited to the illustrated embodiments; rather, these embodiments are intended to fully and completely disclose the invention to those skilled in this art. In the drawings, like numbers refer to like elements throughout. Thicknesses and dimensions of some components may be exaggerated for clarity. Well-known functions or constructions may not be described in detail for brevity and/or clarity.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein the expression "and/or" includes any and all combinations of one or more of the associated listed items.

Where used, the terms "attached", "connected", "interconnected", "contacting", "coupled", "mounted" and the like can mean either direct or indirect attachment or contact between elements, unless stated otherwise.

In addition, some components of the seating units described herein (particularly mechanisms thereof) are illustrated herein as a series of pivotally interconnected links or members. Those skilled in this art will appreciate that the pivots between links or other components can take a variety of configurations, such as pivot pins, rivets, bolt and nut combinations, and the like, any of which may be suitable for use with the present invention. Also, the shapes and configurations of the links themselves may vary, as will be understood by those skilled in this art. Further, some links may be omitted entirely in some embodiments, and additional links may be included in some embodiments.

Referring now to the figures, a reclining chair, designated broadly at 10, is illustrated in FIG. 1. The chair includes a base 12 that rests on an underlying surface and includes a frame 14, a seat 16, a backrest 18, and rear, main, and front ottomans 20*a*, 20*b*, 20*c* (only the main ottoman 20*b* is visible in FIG. 1). These structures are interconnected with a pair of reclining mechanisms 21 (see FIG. 4). These components are discussed in greater detail below.

Figure 5:
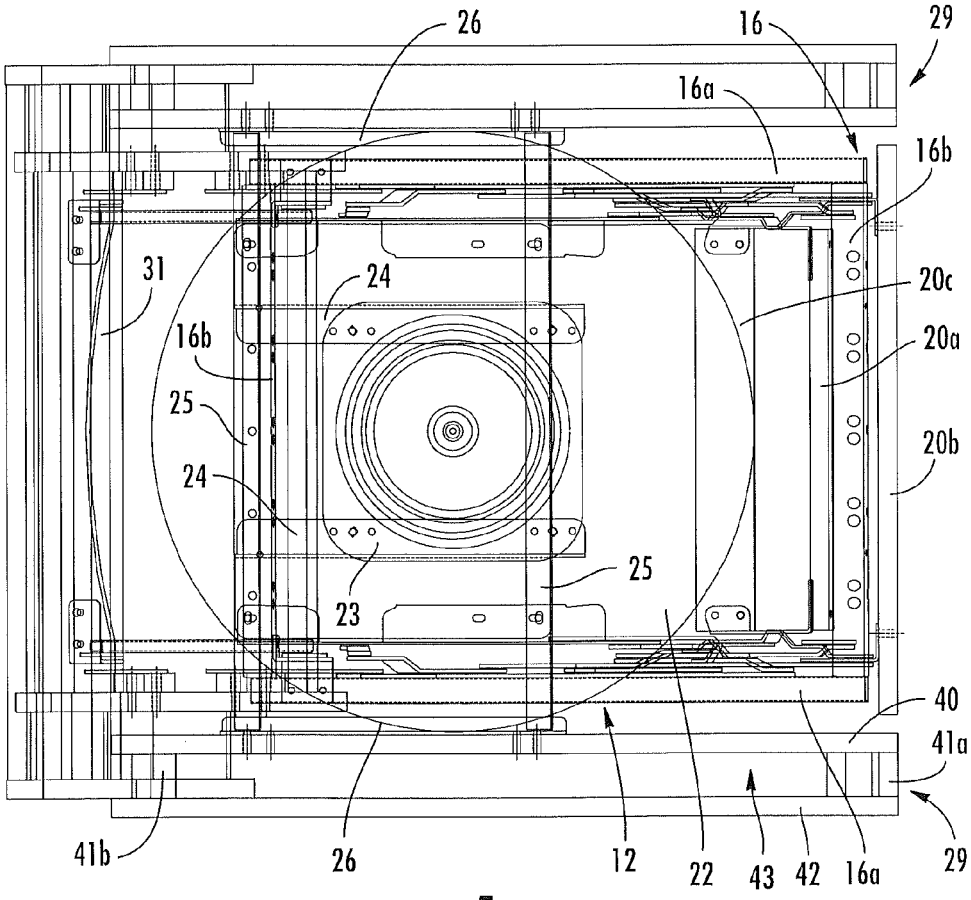
FIG. 5 is a top section view of the chair of FIG. 1, with the chair in its upright position.

Referring now to FIG. 5, the base 12 includes a flat, circular foundation 22 that rests on the floor or other underlying surface, a swivel unit 23 that is mounted on the foundation 22, two longitudinally-extending rails 24 that are fixed to the top plate of the swivel unit 23, two cross-members 25 that are fixed onto to the upper surfaces of the rails 24, and arm brackets 26 that are fixed to the outer ends of the cross-members 25. Thus, the rails 24, the cross-members 25 and the arm brackets 26 form a rigid unit that rotates in concert with the upper plate of the swivel unit 23.

The frame 14 includes arms 29 and a rear panel 31 that spans the arms 29. Each arm 29 comprises an inner panel 40 and an outer panel 42 that are separated by spacers 41*a*, 41*b*, thereby forming a cavity 43 within each arm 29. The arm brackets 26 are mounted to the inner surfaces of the inner panels 40.

Still referring to FIG. 5, the seat 16 includes side rails 16*a* and cross-members 16*b*, which combine to form a generally square structure. A cushion (shown in FIG. 1) rests on the side rails 16*a* and cross-members 16*b*. A seat panel 84 is mounted to the outside of each side rail 16*a*.

Turning now to the reclining mechanism 21, each of the reclining mechanisms 21 is a mirror image of the other reclining mechanism about a vertical plane that extends from the front of the chair 10 to the rear centered between the arms 29. In the interest of brevity, only one reclining mechanism 21 will be described herein, with the understanding that the discussion is equally applicable to the other reclining mechanism 21. Also, the reclining mechanism will be described first with respect to the fully reclined position (FIG. 4) in order to illustrate more easily the interconnection of the various links thereof.

Figure 4:
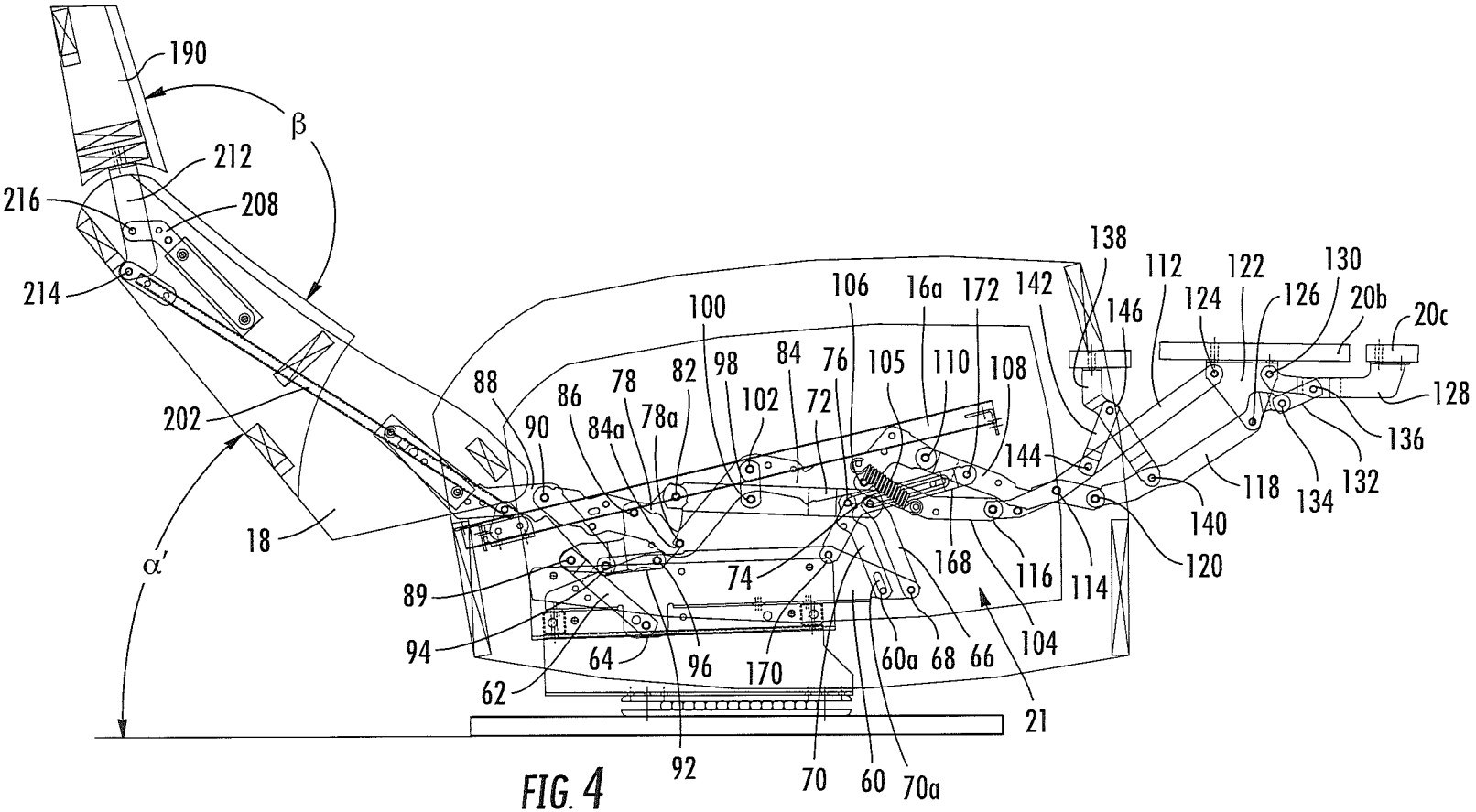
FIG. 4 is a side section view of the chair of FIG. 1, with the chair in its fully reclined position and the headrest extended.

Referring still to FIG. 4, the reclining mechanism 21 has an angled frame bracket 60 mounted to the inner surface of the inner arm panel 40. A rear swing link 62 is attached at its lower end to the frame bracket 60 at a pivot 64 and extends upwardly and rearwardly therefrom. A front swing link 66 is attached at its lower end to the frame bracket 60 at a pivot 68 and extends upwardly and slightly rearwardly therefrom. A sequencer link 70 is attached to the frame bracket 60 via slot 70*a* that receives a pin 60*a* on the frame bracket 60. The sequencer link 70 extends upwardly and rearwardly to attach to a connector link 72 at a pivot 76; the front swing link 66 also attaches to the connector link 72 at a pivot 74. The connector link 72 extends substantially rearwardly from the pivot 76 to a pivot 82 with a transition plate 78. The transition plate 78, which has three fingers, is attached by its middle finger to the seat panel 84 at a pivot 86, and is also attached at its rear finger with the upper end of the rear swing link 62 at a pivot 89. A control link 98 is attached to the seat panel 84 at a pivot 102 and to the connector link 72 at a pivot 100.

Still referring to FIG. 4, a tripartite backpost 88 is fixed to the backrest 18 and extends downwardly and forwardly therefrom. At one of its interior vertices, the backpost 88 is attached to the seat panel 84 at a pivot 90. A drive link 92 is attached to the lower, forward end of the backpost 88 at a pivot 94 and extends forwardly therefrom to a pivot 96 with the lower portion of the transition plate 78.

Referring still to FIG. 4, a rear ottoman drive link 104 is attached at a pivot 106 to the seat panel 84 and extends forwardly therefrom. A spring 105 extends between the rear ottoman drive link 104 and the seat panel 84. A front ottoman drive link 108 is attached at a pivot 110 to the seat panel 84 at a pivot that is positioned forwardly and upwardly from the pivot 106. A rear ottoman extension link 112 is attached to the forward end of the rear ottoman drive link 104 at a pivot 116 and extends forwardly and upwardly therefrom; the rear ottoman extension link 112 is also attached to an intermediate section of the front ottoman drive link 108 at a pivot 114. A front ottoman extension link 118 is attached at its rear end to the front end of the front ottoman drive link 108 at a pivot 120 and extends forwardly and upwardly therefrom generally parallel with the rear ottoman drive link 112. A main ottoman bracket 122, to which the main ottoman 20*b* is mounted, is attached to the forward ends of the rear ottoman drive link 112 and the front ottoman drive link 118 at, respectively, pivots 124 and 126.

Referring once again to FIG. 4, a front ottoman bracket 128 is attached to the main ottoman bracket 122 at a pivot 130 and extends forwardly therefrom. The front ottoman 20*c* is mounted to the forward end of the front ottoman bracket 128. A control link 132 extends between a pivot 134 with the front ottoman extension link 118 and a pivot 136 with the front ottoman bracket 128. A rear ottoman bracket 138 is attached to the front ottoman extension link 118 at a pivot 140 and extends upwardly and rearwardly to support the rear ottoman 20*a* mounted thereon. A bracing link 142 extends between a pivot 144 with the rear ottoman extension link 112 and a pivot 146 with the rear ottoman bracket 138.

A drive link 168 is attached to the front ottoman drive link 108 at a pivot 172, and extends rearwardly therefrom to a pivot 170 with the frame mounting bracket 60.

Figure 3:
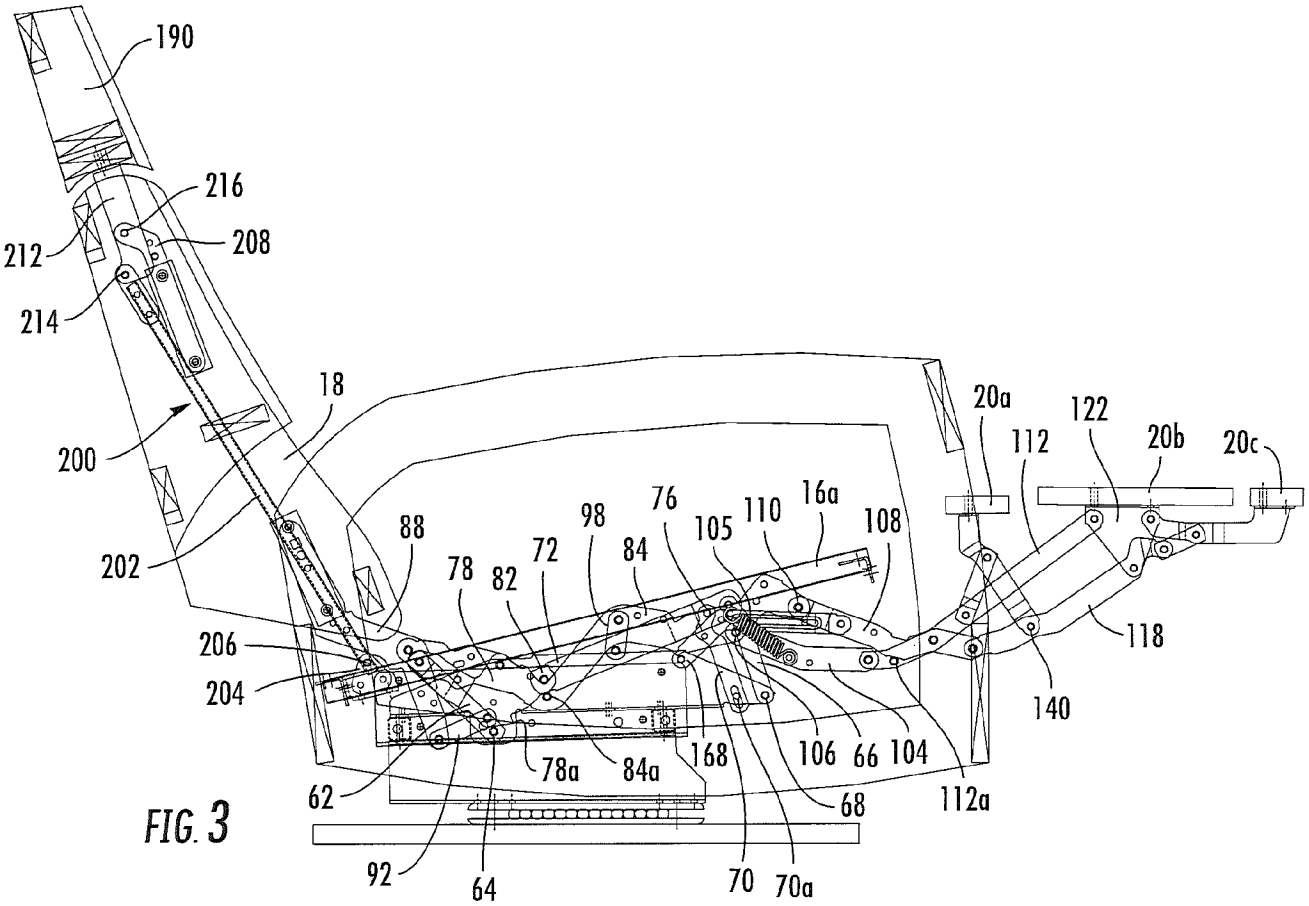
FIG. 3 is a side section view of the chair of FIG. 1, with the chair in its TV position and the headrest retracted.
Figure 6:
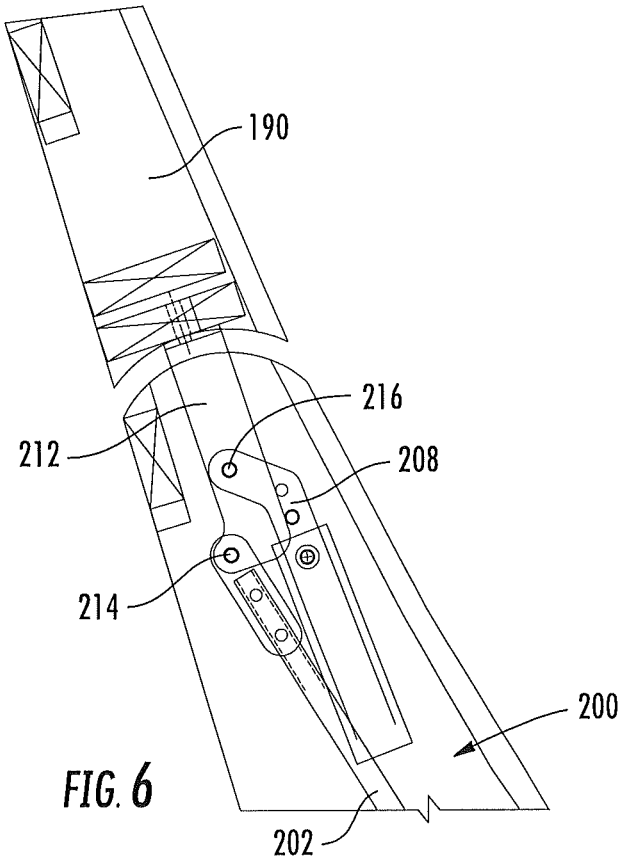
FIG. 6 is an enlarged side section view of the backrest and headrest of the chair of FIG. 1, with the headrest in its retracted position.

Referring now to FIGS. 3 and 6, the headrest 190 is attached to a headrest mechanism 200, which controls its movement. The headrest mechanism 200 includes a extending link 202 that is pivotally mounted at a pivot 206 to a bracket 204 fixed to the seat rail 16*a*. The extending link 202 extends upwardly and rearwardly following the profile of the backrest 18. An angled bracket 208 is positioned slightly forwardly of the upper portion of the extending link 202. A headrest link 212 is pivotally attached at its lower end to the extending link 202 at a pivot 214 and at its intermediate portion to the upper end of the bracket 208 at a pivot 216. The headrest 190 is fixed to the upper end of the headrest link 212. The headrest 190 is generally parallel with the backrest 18, with its front surface facing forwardly.

Figure 2:
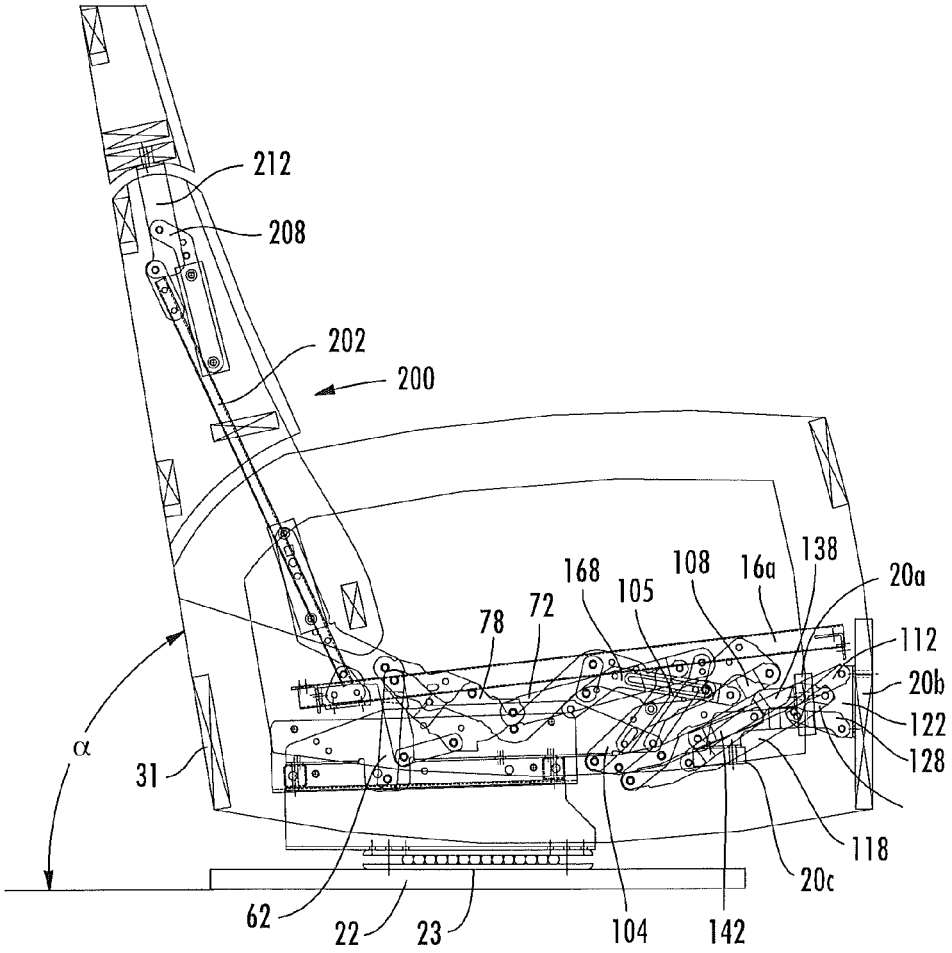
FIG. 2 is a side section view of the reclining mechanism of the chair of FIG. 1, with the mechanism in the upright position and the headrest retracted.

Operation of the chair typically begins in the upright position (FIG. 2). In the upright position, the ottomans 20*a*, 20*b*, 20*c* are all folded beneath the seat 16, with the main ottoman 20*b* positioned below the front of the seat 16 and vertically disposed, the rear ottoman 20*a* behind the main ottoman and vertically disposed, and the front ottoman 20*c* horizontally disposed and facing the underlying surface. The links comprising the portion of the reclining mechanism 21 that extends the ottoman (i.e., the front and rear ottoman drive links 108, 104, the front and rear ottoman extension links 118, 112, the front, main and rear ottoman brackets 128, 122, 138, the control link 132, and the bracing link 142) are folded beneath the seat 16 as a pantographic linkage. The seat 16 is disposed above the base 12 and typically has a pitch angle of between about 5 and 8 degrees relative to horizontal, and the backrest 18 has a first backrest angle a of between about 60 and 80 degrees relative to horizontal. The components of the headrest mechanism 200 are in the positions discussed above in connection with FIG. 3, such that the headrest 190 is positioned above and generally parallel with the backrest 18. The reclining mechanism 21 is maintained in place by tension in the spring 105, which urges the reclining mechanism 21 toward the upright position.

To move the chair 10 to the TV position of FIG. 3, the occupant of the chair 10 pushes forwardly on the arms 29, which action forces the occupant's back rearwardly into the backrest 18. Forcing the backrest 18 and seat 16 rearwardly relative to the base 12 draws the seat 16 and seat panel 84 rearwardly; this movement is largely controlled by the rear swing link 62, the front swing link 66, and the sequencer link 70. As the seat 16 moves rearwardly, the drive link 168 rotates only slightly, with the net effect that the front ottoman drive link 108 rotates counterclockwise considerably about the pivot 110. This action also extends the front and rear ottoman extension links 118, 112, which in turn rotates the rear ottoman link 104 counterclockwise about the pivot 106. Once rotation of the rear ottoman drive link 104 causes the axis defined by the spring 105 to pass the pivot 106, the spring 105 then urges the rear ottoman drive link 104 toward the TV position. Relative separation of the front and rear ottoman extension links 118, 112 also rotates the main ottoman bracket 122 and the main ottoman 20*b* to a generally horizontal disposition in front of the seat 16. Extension of the front ottoman extension link 118 and rotation of the main ottoman bracket 122 also draws forward and inverts the front ottoman bracket 128 and the front ottoman 20*c*. Extension and separation of the front and rear ottoman extension links 118, 112 also forces the rear ottoman bracket 138 and the rear ottoman 20*a* upwardly and rotates the rear ottoman bracket about the pivot 140. Extension of the ottomans 20*a*, 20*b*, 20*c* ceases when the lower edge of the front ottoman drive link 108 strikes a stop pin 112*a* on the rear ottoman extension link 112.

Rearward movement of the seat 16 also forces the backrest 18 rearwardly relative to the frame 14 and rotates the backrest 18 very slightly counterclockwise. However, the backrest 18 substantially retains the first backrest angle between it and the seat 16 observed in the upright position of FIG. 2. As a result, the headrest 190 experiences little to no movement relative to the backrest 18. In addition, rearward movement of the seat 16 draws the transition plate 78 rearward. This movement rotates the rear swing link 62 counterclockwise about the pivot 64 and draws the connecting link 72 rearwardly. As a result, the front swing link 66 and the sequencer link 70 rotate counterclockwise about their respective pivots 68, 60*a* (the sequencer link 70 also rises slightly relative to the pin 60*a* in its slot 70*a*, such that the pin 60*a* is in the center of the slot 70*a*).

To move the chair 10 to the fully reclined position of FIG. 4, the occupant again pushes forwardly on the arms 29, which forces the occupant's back into the backrest 18. This action forces the backpost 88 and the backrest 18 to rotate counterclockwise about the pivot 90 and move to a reclined position relative to the seat 16. Rotation of the backpost 88 drives the drive link 92 forwardly, which in turn causes the transition plate 78 to rotate counterclockwise about the pivot 89. Rotation of the transition plate 78 drives the seat panel 84 upwardly. As the seat panel 84 rises, through the control link 98 it pulls the connecting link 72 upwardly and rotates it clockwise about the pivot 76. Rotation ceases when an edge 78*a* of the transition plate 78 contacts a pin 84*a* on the seat panel 84. In this position, the backrest 18 typically reclines at a second backrest angle $\alpha'$ of between about 45 and 65 degrees relative to horizontal.

Figure 7:
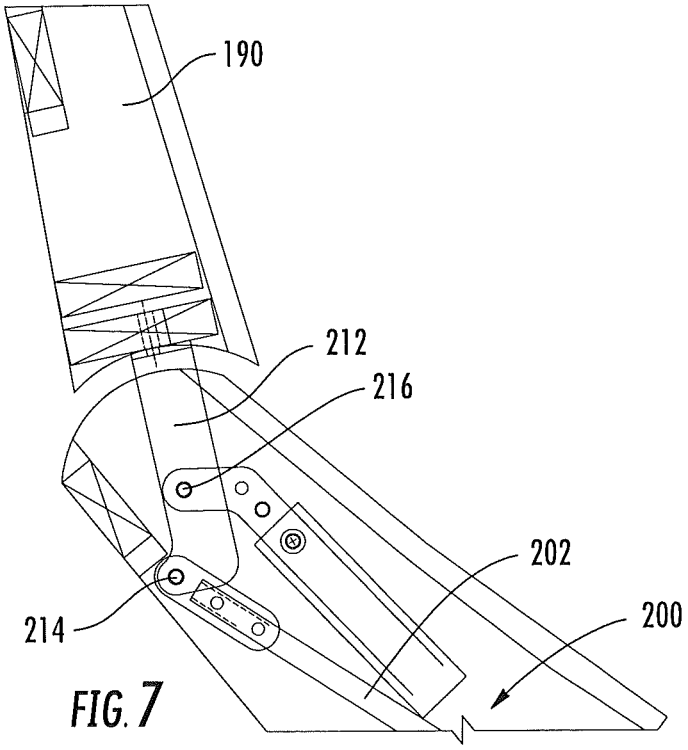
FIG. 7 is an enlarged side section view of the backrest and headrest of the chair of FIG. 1, with the headrest in its extended position.

Also, the rising of the seat 16 relative to the backrest 18 forces the extending link 202 upwardly. This movement forces the headrest link 212, and in turn the headrest 190, to rotate clockwise about the pivot 216 from the retracted position of FIGS. 2, 3 and 6 to the extended position of FIGS. 4 and 7. In the fully reclined position, the headrest 190 has rotated to a forwardly-tilted position that defines an angle $\beta$ of between about 25 and 35 degrees relative to the backrest 18, wherein the front surface of the headrest 190 partially faces the front surface of the backrest 18 In this position, the headrest 190 can provide a more comfortable support for a seated occupant for some activities (for example, watching television).

The chair 10 can be returned to the TV and/or upright position by the occupant pushing downwardly with his feet on one or more of the ottomans 20*a*, 20*b*, 20*c*. The links of the reclining mechanism 21 will reverse the various movements described above.

Those skilled in this art will recognize that the headrest mechanism 200 may be employed with a variety of reclining seating units, including sofas and sectional units, rockers, and gliders, including those that have fewer, or even no, ottomans. Also, the headrest mechanism may be employed with different reclining mechanisms, including one-way, two-way, zero-wall and wall-proximity units, and can be used with seating units that actuate in different ways, such as handles, release levers, and the like.

Figure 8:
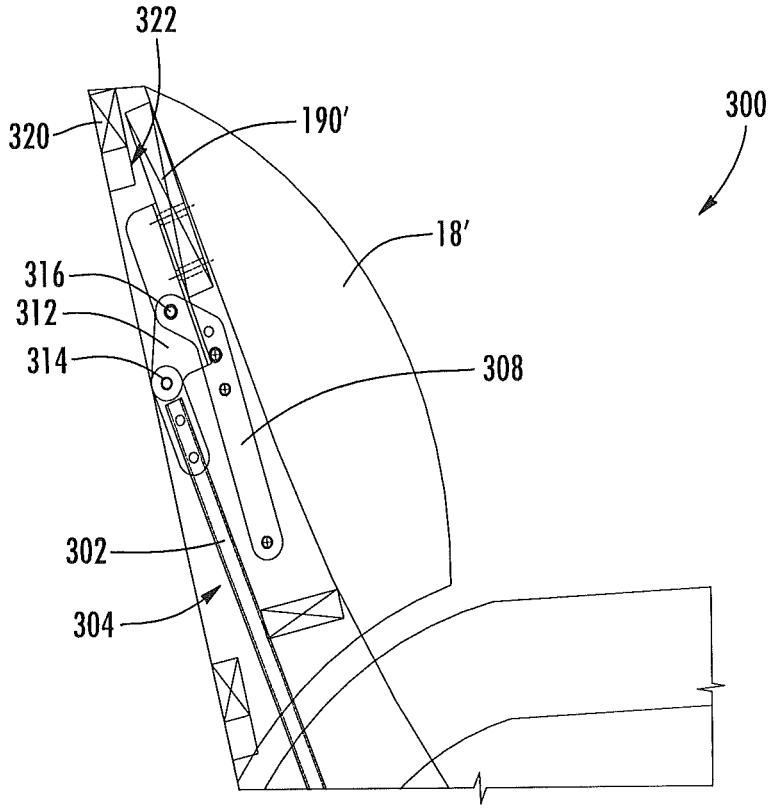
FIG. 8 is an enlarged side section view of the backrest and headrest of a chair according to additional embodiments of the invention, with the headrest in its retracted position.
Figure 9:
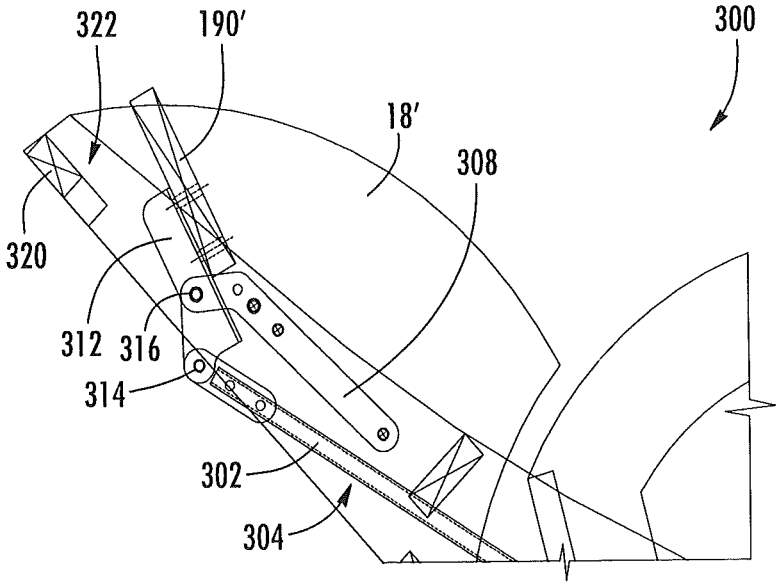
FIG. 9 is an enlarged side section view of the backrest and headrest of the chair of FIG. 8, with the headrest in its extended position.

Another embodiment of the chair 10 is illustrated in FIGS. 8 and 9 and designated broadly at 300. The chair 300 may be identical to the chair 10 except for the configuration of the backrest 18' and, as a consequence, the headrest mechanism 304. The backrest 18' extends to the full height of the chair 300 and has a cross-member 320 across the top. As such, the headrest 190' does not rest on top of the backrest as in the chair 10, but instead rests in a pocket 322 located in front of the cross-member 320. As shown in FIG. 8, the headrest mechanism 304 includes an extending link 302 and a bracket 308 like those of the chair 10. Also, the headrest link 312 is pivotally connected to the extending link 302 and the bracket 308 at pivots 314, 316 in the manner of the headrest mechanism 200. However, the headrest link 312 mounts to the rear surface of the headrest 190' rather than mounted from beneath.

In operation, the headrest mechanism 304 operates in the same manner as the headrest mechanism 200, with the extending link 302 being forced upwardly relative to the backrest 18' as the seat rises in moving to the fully reclined position. This movement causes the headrest link 312, and in turn the headrest 190', to rotate forwardly relative to the backrest 18' away from the pocket 322 (FIG. 9). The headrest mechanism 304 provides the chair designer with another option in designing a chair with a rotating headrest, if the preferred style is a backrest that, when viewed from the side, displays a single monolithic piece.

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention.

That which is claimed is:

1. A reclining seating unit, comprising:

a base configured to rest on an underlying surface;

a seat;

a backrest;

a reclining mechanism attached to the base, seat and backrest, the reclining mechanism configured to move the seating unit between an upright position, in which the seat is disposed above the base and the backrest defines a first backrest angle relative to the seat, and a fully reclined position, in which the backrest has reclined relative to the seat to a second backrest angle that exceeds the first backrest angle;

a headrest that is positioned in front of an upper portion of the backrest; and a headrest mechanism attached to the headrest and to the reclining mechanism, the headrest mechanism configured to move the headrest from a retracted position when the seating unit is in its upright position to an extended position when the seating unit is in its fully reclined position, wherein in the retracted position the headrest is generally parallel with the backrest and in the extended position the headrest defines an angle with the backrest in which a front surface of the headrest is rotated to partially face a front surface of the backrest;

wherein the reclining mechanism is configured to move the seating unit from the upright position to an intermediate TV position, in which a pitch angle between the seat and the underlying surface increases; and wherein the headrest remains in the retracted position when the seating unit moves to the TV position.

2. The reclining seating unit defined in claim 1, wherein the seating unit further comprises at least one ottoman, and wherein the reclining mechanism is configured to move the ottoman from a retracted position, in which the ottoman is vertically disposed and positioned below the seat, and an extended position, in which the ottoman is generally horizontally disposed and positioned in front of the seat, and wherein the ottoman takes the retracted position when the seating unit is in the upright position and takes the extended position when the seating unit is in the TV and fully reclined positions.

3. The reclining seating unit defined in claim 1, wherein the headrest rotates between about 25 and 35 degrees relative to the backrest in moving between the retracted and extended positions.

4. The reclining seating unit defined in claim 1, wherein the headrest mechanism comprises:

a headrest link fixed to the headrest and pivotally attached to the backrest; and an extending link pivotally attached to the headrest link.

5. The reclining seating unit defined in claim 4, wherein the extending link is pivotally attached to the seat.

6. A reclining seating unit, comprising:

a base configured to rest on an underlying surface;

a seat;

a backrest;

a reclining mechanism attached to the base, seat and backrest, the reclining mechanism configured to move the seating unit between an upright position, in which the seat is disposed above the base and the backrest defines a first backrest angle relative to the seat, and a fully reclined position, in which the backrest has reclined relative to the seat to a second backrest angle that exceeds the first backrest angle;

a headrest that is positioned in front of an upper portion of the backrest; and a headrest mechanism attached to the headrest and to the reclining mechanism, the headrest mechanism configured to move the headrest from a retracted position when the seating unit is in its upright position to an extended position when the seating unit is in its fully reclined position, wherein in the extended position the headrest is tilted forward with respect to the backrest compared to the retracted position;

wherein the reclining mechanism is configured to move the seating unit from the upright position to an intermediate TV position, in which a pitch angle between the seat and the underlying surface increases; and wherein the headrest remains in the retracted position when the seating unit moves to the TV position.

7. The reclining seating unit defined in claim 6, wherein the seating unit further comprises at least one ottoman, and wherein the reclining mechanism is configured to move the ottoman from a retracted position, in which the ottoman is vertically disposed and positioned below the seat, and an extended position, in which the ottoman is generally horizontally disposed and positioned in front of the seat, and wherein the ottoman takes the retracted position when the seating unit is in the upright position and takes the extended position when the seating unit is in the TV and fully reclined positions.

8. The reclining seating unit defined in claim 6, wherein the headrest rotates between about 25 and 35 degrees relative to the backrest in moving between the retracted and extended positions.

9. The reclining seating unit defined in claim 6, wherein the headrest mechanism comprises:

a headrest link fixed to the headrest and pivotally attached to the backrest; and an extending link pivotally attached to the headrest link.

10. The reclining seating unit defined in claim 9, wherein the extending link is pivotally attached to the seat.

* * * * *